United States Patent [19]

Colterjohn, Jr.

[11] Patent Number: 4,868,450

[45] Date of Patent: Sep. 19, 1989

[54] RADIATION DEVICE

[76] Inventor: Walter L. Colterjohn, Jr., 1201 Oak Ridge Cir., Barrington, Ill. 60010

[21] Appl. No.: 314,295

[22] Filed: Feb. 22, 1989

Related U.S. Application Data

[63] Continuation-in-part of Ser. No. 155,262, Feb. 12, 1988, abandoned.

[51] Int. Cl.[4] ..... H01J 61/06; H01J 61/34; H01J 51/35

[52] U.S. Cl. ..... 313/36; 313/44; 313/113; 313/632; 313/635

[58] Field of Search ..... 313/36, 44, 113, 117, 313/631, 632, 634, 635

[56] References Cited

U.S. PATENT DOCUMENTS 2,045,288 6/1936 Barthelemy ..... 313/117
3,775,609 11/1973 Dank ..... 313/113 X

*Primary Examiner*—Kenneth Wieder
*Attorney, Agent, or Firm*—J. R. Halvorsen

[57] ABSTRACT

This invention provides a source of optical radiation of high brightness obtained from an output window that is located on the axis of an extended length arc discharge device. The arc discharge device is confined by an electrically insulating tubular element, and caused by the tubular element to have an extended length to diameter ratio. The tubular element is provided with a reflecting surface that improves efficiency and increases output. Means are provided to transfer heat from the tubular element and to support high internal gas pressure, and to thereby facilitate use of a very high brightness arc discharge.

30 Claims, 4 Drawing Sheets

RADIATION DEVICE

This application is a continuation-in-part of application Ser. No. 155,262 filed Feb 12, 1988 now abandoned.

BACKGROUND OF THE INVENTION

For many applications, a source of optical radiation of high brightness is required which can be effectively used with associated optics to provide intense illumination. In the case of the projection of a photographic image, the brightness of the primary source, and the ability of the optics to collect and direct it through the film area and into the projection lens, determine the adequacy of the projected image brightness. In search lights and beacons, the source brightness and the nature of the associated optics that are required determine how concentrated and intense the beam can be for a given size of the illuminator, i.e., a light source and its associated optics, such as the reflector, lenses and light carriers. In the case of many scientific, medical and industrial applications that each require an intense source of optical radiation, similar considerations often apply and influence the equipment cost, size and performance capability.

The most generally used source of optical radiation when high brightness is required is the short arc lamp. These have electrodes rather closely spaced in a relatively large fused silica envelope. The lamps operate with a high internal gas pressure to improve arc intensity and efficiency. The lamps have a rather low electrical impedance and require a high current. Due to this the anode dissipation, or electrical energy lost, is high being typically one third of the power input. This reduces lamp efficiency and requires the use of an oversized anode to maintain intensity and to permit adequate cooling.

The radiation from the lamp is symmetrical about the axis defined by the electrodes and is in the form of a broad distribution about the radial plane. This distribution determines the nature of the collection optics when good efficiency is required. A parabolic shaped reflector positioned about the lamp is generally used when far-field illumination is needed, as is the case with search lights and beacons. This arrangement is adequate for many purposes but it does not permit minimum divergence to be obtained due to variation in the distance of the reflector surface from the arc. Light that is incident on the reflector surface closest to the source has higher divergence. An ellipsoidal reflector is often used when efficient near-field illumination is needed, as is the case with the illumination of photographic film for image projection. In this type of reflector, the lamp is placed at one focal point and the input to the projection lens is placed at the other focal point. The collection of radiation in an ellipsoidal reflector is good but the optical aberrations prevent directing the light to the required output area with optimum concentration. Also the angular divergence of the light incident on the lens is excessive so that a relatively fast (maximum aperture) projection lens is required to utilize the light.

In addition to the above problems in providing optimum illumination, it should be mentioned that short arc lamps exhibit some instability in the position of their arc which can be very undesirable in some applications. They also require specific orientations when operating, which often imposes operational and equipment design problems. These lamps also, are somewhat dangerous to handle because of high internal pressure and sometimes explode when in operation.

A further problem that occurs with some forms of annular ring electrodes is a tendency for the arc to not distribute the current that it carries in a adequately uniform manner in its conduction to the anode. This can result in one segment of the window becoming overheated and another segment being underheated. Conceivably this condition perhaps could result in melting or thermal fracturing of the window or alternatives, in the deposition of an ode material on the window.

OBJECTS OF INVENTION

It is an object of this invention to provide an optical radiation source having a light output characterized by a high brightness.

Another object of this invention is to provide a source of optical radiation of high brightness in which the radiation is emitted within a relatively limited angle about its axis.

A further object of this invention is to provide in combination with said source a preferred optical arrangement for the collection, collimination and direction of the radiation.

Still another object of this invention is to provide a source of optical radiation in which there is efficient collection of radiation from an elongated arc lamp in the axial direction of the arc lamp.

It is a further object to provide means in a light source which minimizes the deposit of electrode material on the co-axially disposed window surface of said source.

A still further object of this invention is to provide a source of optical radiation that has a stable position and can be operated in all orientations.

An additional object of this invention to provide a high power, high brightness source of optical radiation that incorporates convenient and efficient cooling means.

It is also an object of the present invention to provide means for insuring substantially uniform distribution of the arc current passing from the electrode to the anode, thereby avoiding nonuniform heating of the window.

SUMMARY OF THE INVENTION

These and other objectives are achieved by utilizing as a source of optical radiation an electric arc positioned within a high pressure gas medium between electrodes situated a opposite ends of a tubular shaped chamber having electrically insulated walls that serve to confine the arc and provide it with an increased length to diameter ratio. The insulating walls are relatively thin and in good thermal contact with an exterior enclosure structure to permit the efficient transfer of heat from the interior surface of the insulating walls through the exterior enclosure to a cooling medium. The exterior enclosure substantially encapsulates the insulating walls and resists the force resulting from the internal arc gas pressurization. The enclosure also has the ability to apply a compressive force to the insulating walls to counteract thermal gradient forces that could cause it to fracture. The enclosure includes a window positioned at one end of the tubular arc chamber on the chamber axis. The window is adapted to accept radiation from the arc in an axial direction and transmit the radiation to the exterior of the enclosure. One electrode, serving as the anode, is adjacently positioned about the window and preferably is in a annular disposition. It may be a substantially continuous annulus or may be a plurality of anodes annularly disposed. This one electrode is preferably disposed about the window so as not to obstruct light from entering the window.

The tubular chamber is preferably tapered to its largest diameter at the axially positioned window. A reflective surface conforms to the surface of the tubular chamber and serves to reduce absorption of radiation from the ar incident upon the chamber surface and to redirect said radiation to the output window or back into the arc for the purpose of increasing efficiency and intensity of radiant output.

The overall source of optical radiation contemplated by this invention may also include as an integral part of the aforementioned window, or as an item separate from but in close proximity to it, a collimating light conduit which reduces beam divergence by internal reflection from its tapered surfaces. This conduit may have on its output surface a reflective coating that limits output to a specific required shape and/or a specific spectral region while reflecting other radiation back to the arc for reabsorption and improvement of efficiency. The utilization of a plurality of annularly disposed anodes can result in the uniform distribution of the arcs current flow and hence a uniformity of thermal gradient distribution.

The objectives enumerated can also be accomplished by utilizing an arc discharge within a tubular insulating chamber, as described above, in which the insulating chamber has adequate strength to withstand the forces created by the internal gas pressure and the thermal gradient without external support by a secondary structure.

DETAILED DESCRIPTION

Figure 1:
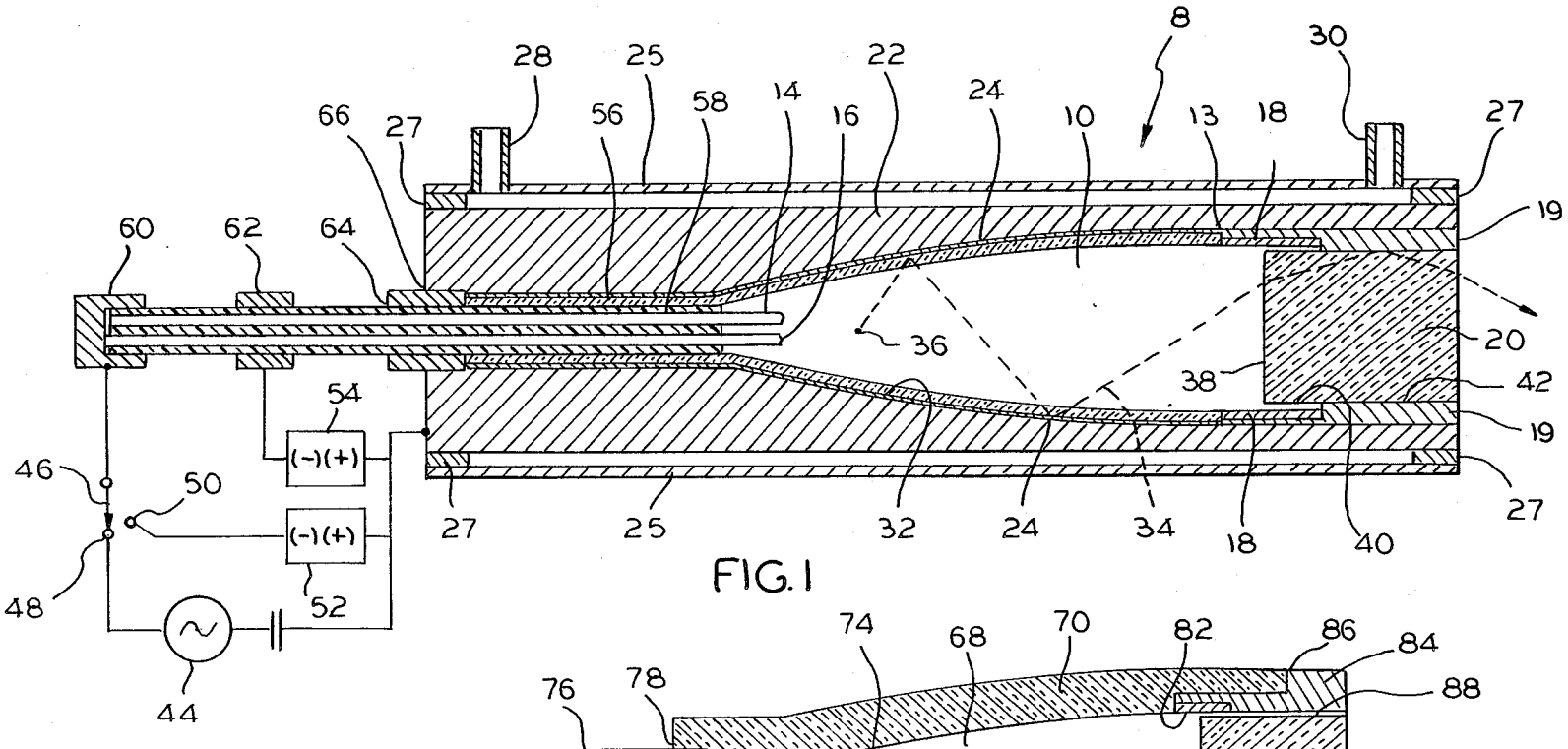
FIG. 1 is a sectional view of a preferred embodiment of the invention showing an axially directed source of radiant energy in which a support structure is utilized to provide support to thin insulating chamber walls to resist internal gas pressure and thermal gradiant forces.

Referring now to the drawing, and particularly FIG. 1, the structure of the light source 8 is shown to include a diverging tubular shaped arc chamber 10 having a electrically insulating chamber wall 12 with at least one cathode and one anode spaced therefrom. In the illustrated preferred embodiment there are dual cathodes 14 and 16 at one end and an annular anode 18 at the other end. A co-axially disposed window 20 is located adjacent the anode 18. A rigid envelope structure 22 encapsulates chamber wall 12 and insures containment of the pressurized arc gas. This envelope structure 22 is preferably metallic and is in good thermal contact with the arc chamber wall 12 via a heat conducting interface 24. A shell 25 encircles envelope 22 in spaced relation by means of sealing rings 27 to form &he passage 26 which serves as means for passage of a coolant, such as water or any other fluid coolant medium, flowing between inlet 28 and outlet 30. The insulating arc chamber wall 12 is preferably transparent and is provided with a reflective coating (not shown) on or adjacent to its outer surface 32. Fused silica is a suitable material for the chamber wall 12 and silver or aluminum are suitable materials for the reflective coating.

The dashed line 34 traces a ray and illustrates how radiation generated by the arc at point 36 is caused, by multiple reflections, to be directed to the output window 20. The window 20 is of substantial thickness and utilizes reflection along its longitudinally disposed surface, in this case a cylindrical surface, to keep the radiation confined to an output that is of the same area as the input thereby substantially preventing loss in brightness. It is preferable that the input window surface 38 operate at a relatively uniform temperature that is high enough to prevent depositing of evaporated material from the anode by condensation. To facilitate this, thermal contact to the lateral surfaces of the window 20 in the region 40 adjacent to the inner end input window surface 38 is avoided and contact is made along a surface spaced from end 38 commencing at a point as at 42. The anode 18 is made of material which has a high enough vapor pressure when measured at the temperature of the windows 20 input surface 38, that it would not remain deposited there when evaporated by the arc.

In this embodiment, two cathodes 14 and 16 are used. This is done to facilitate the initiation of the arc between cathode and anode 18 at a lower voltage than would otherwise be possible. An arc is first established between the closely spaced cathodes 14 and 16 and then the arc is established between the cathodes 14 and 16 and the anode 18. The preferred thickness of the insulating wall 12 of the arc chamber 10 is determined by how much high voltage must be used to initiate the main arc. It is desirable to keep the wall 12 relatively thin to prevent overheating at high power input, and this is facilitated by the use of two cathodes or by other means that limits the amount of high voltage required. The application of starting voltage from power source 44 is done when switch 46 is in position 48. Closing of switch 46 to position 48 causes current to flow in one direction to the connector 60 and thence to cathode 16 while in the other direction it flows through power source 54 and connector 62 to cathode 14 to strike an initial arc between the closely positioned cathodes 14 and 16. After this initial arc is established, an electrical discharge would take place between cathode 16 and the annular anode 18. Placing the switch in position 50 then permits both cathodes 14 and 16 to feed the arc through their respective power sources 52 and 54.

The heat transfer interface 24 between the enclosure 22 and the insulating tube 12 may be mechanically non compliant and there may be a difference in the thermal expansion coefficients between 12 and 22. The insulating tube 12 preferably could be made of fused silica while the enclosure 22 preferably could be made of molybdenum. Because of the weakness of fused silica in tension, it is desirable to keep the tube 12 in compression at all times. This can be accomplished by causing a shrink fit of the enclosure 22 down upon the fused silica tube 12 and interface 24 by heating enclosure 22 to an adequately high temperature then assembling it with tube 12 and interface 24, followed by a cooling cycle to shrink enclosure 22 about tube 12. This created compression will not be overcome by the force of the created rise of internal gas pressure against the internal surface of tube 12 after an arc is struck nor will such compression be relieved by the differential thermal expansion between the tube and the enclosure 22 due to operating temperature rise.

If the interface 24 is made compliant to accomodate the differential expansion of 12 and 22 it will not likely be able to keep the insulating tube 12 from being subject to high tensile pressure due to the internal gas pressure. A compliant interface would best be made porous so that the gas pressure can equalize on both sides of the tube. As car be best seen at the right hand end of FIG. 1, annular ring anode 18 is mounted in one end of a recessed carrier ring 19, which recess also provides the radial gap 40 between ring 19 and window 20. The ring 19 also supports window 20, as at 42, with the opposite end to the recess sealing the space between window 20 and the open end of enclosure 22. The axial extent of ring 19 at the opposite end stops short of contacting the end of tube 1 with the spacing 13 between ring 19 and tube 12 serving a double function. First, spacing 13 will accomodate axial thermal expansion of the parts and, secondly, will provide a passageway whereby pressurized gas from chamber 10 can pars through a porous interface 24 and equalize the gaseous pressure on opposite sides of tube 12.

The neck section 56 of the arc chamber electrically insulating tubing 12 in combination with a cathode insulating tube 58 prevents the establishment of a shorting arc in this region. Hermetic seals are provided at the electrode connections 60 and 62 and at the interfaces 64 and 66 between the enclosure and the cathode insulating tube and also at the interface 42 between the window 20 and sealing ring 19 to the enclosure 22.

If the insulating tube 12 is made of synthetic sapphire or of other material which is more susceptible than fused silica to fracture from a large thermal gradient, it is desirable to have the enclosure 22 and the interface 24 very rigid so as to most effectively help prevent the development of excessive tensile forces in the insulating tube. The enclosure would preferably be made of molybdenum because of its strength, rigidity and good thermal conductivity. A very thin layer of a silver-copper alloy or other high strength solder having good adhesion would preferably be used in the interface.

Figure 2:
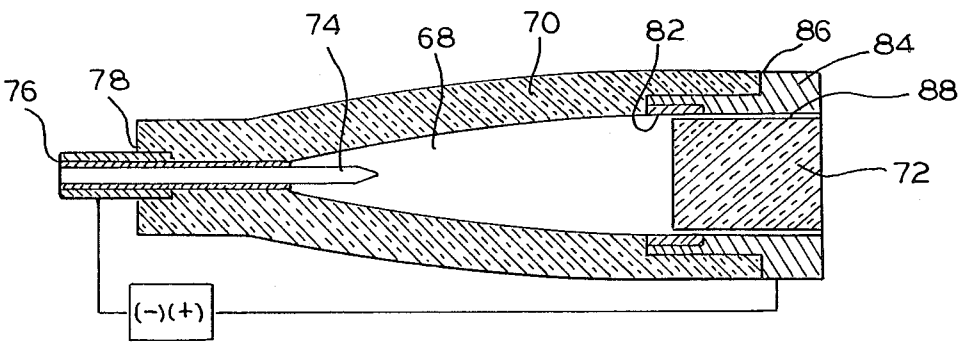
FIG. 2 is a sectional view of an embodiment of the invention in which the insulating chamber walls are adapted to support internal thermal and pressure forces without the need of a separate support structure.

In FIG. 2, a second embodiment of the invention is illustrated in which the arc chamber 68 is defined by a diverging insulating tubular element 70 that has adequate thermal conductivity so that it can be designed in a sufficient thickness that will provide adequate hoop strength to withstand the gas pressure without the need for an exterior support structure. The enclosure 70, if made of a ceramic having good surface reflectivity, would confine the radiation incident on it and provide a diffuse redirection of it back to the arc or to the window 72. The cathode 74 is provided with hermetic seals 76 and 78, while the window 72 is also positioned co-axially at the open end with a surrounding anode 82. Connection to the anode 82 is accomplished through mounting the anode 82 in the recessed sealing conducting ring 84, said ring 84 being hermetically sealed at 86 to element 70 and at 88 to the window 72.

Figure 3:
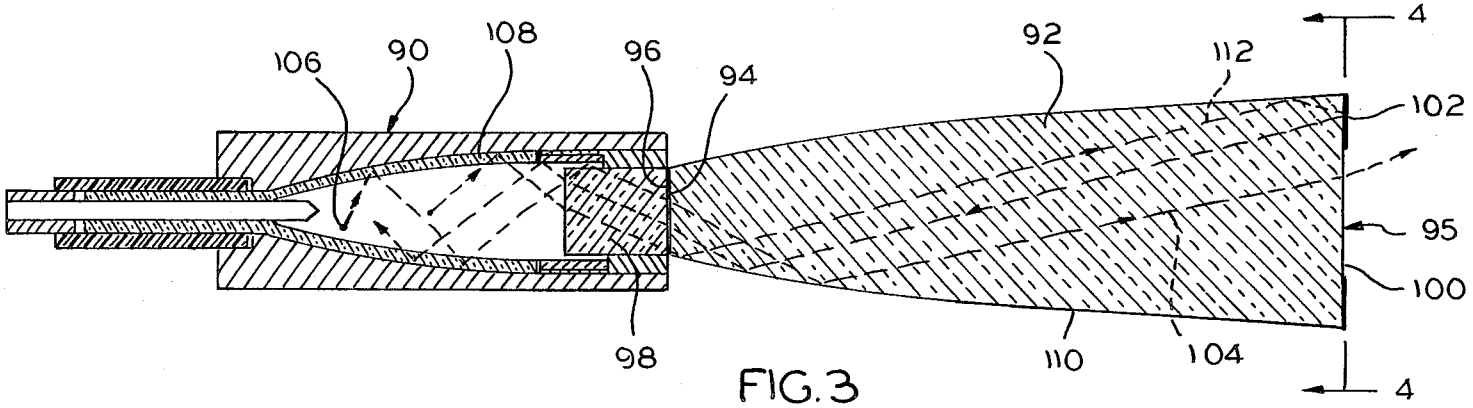
FIG. 3 is a sectional view showing an embodiment of the invention in which an axial emitting source of radiant energy is used in conjunction with a collimating light conduit
Figure 4:
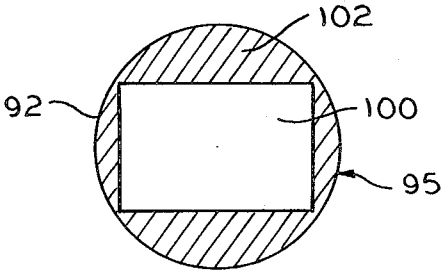
FIG. 4 is an end sectional view of the output face of the light conduit taken along line 4–4 of FIG. 3, and showing the end reflective screen with its predetermined exit aperture shape.

In FIG. 3 an illuminator arrangement is shown which combines an arc lamp source of radiation 90, incorporating the concepts of this invention, with a collimating optical conduit 92 that is of transparent material and utilizes internal reflection to confine and direct the radiation passing through it. The collimating conduit 92, at its input surface 94, is in close proximity to the output surface 96 of the arc lamp window 98. The output surface 95 at the opposite end of the conduit 92 is shown in FIG. 4. At this end an aperture area 100 is defined by a mask 102 through which no visible radiation can pass. The areas of mask 102 defining aperture 100 are formed by coating surface 95 with reflective material such as aluminum to cause radiation incident in these areas to be reflected back and returned to the arc and thereby improve efficiency. To further improve efficiency, a dielectric filter can be used in the region of the aperture 100 to reflect back to the arc radiation in those spectral regions not needed. The dashed line ray trace 104 illustrates the collimation of light from the point 106 in the arc lamp. The surface 108 of the arc chamber wall provides initial collimation while the surface 110 of the light conduit provides additional collimation. This ray is shown to exit in the desired format area 100. The ray 112, which is outside the desired format area 100, is shown to be reflected back by mask 102 through window 98 into the arc.

Figure 5:
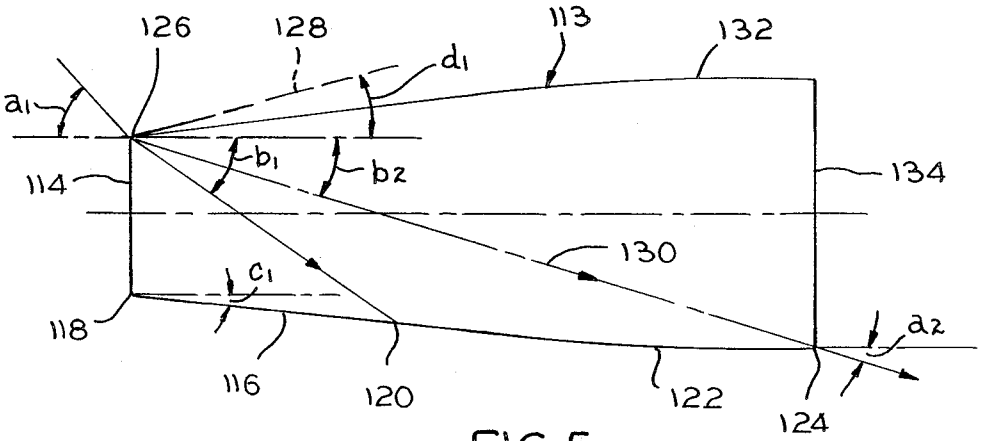
FIG. 5 is a schematic diagram showing construction considerations for a collimating light conduit.

In FIG. 5, a schematic illustration is provided of the function of a light conductor 113 in reducing the divergence of the light with a minimum expansion in area. It is assumed that it is required to accept radiation at the input end surface 114 up to a maximum angle $a_1$, to be directed to the output up to a maximum angle of $a_2$. Light at this input angle is refracted at the input surface to angle $b_1$. The surface 116, between points designated and 120, is set at an angle $c_1$, such that the reflected rays when refracted at the output surface will be at the maximum output angle $a_2$. All rays from the input striking this section of surface at the lesser angle will exit at the output at a lesser angle also.

For this section of the light conductor 113, the surface 122 between transverse planes passing through points 120 and 124 is a parabola having its focal point at 126 and its axis along line 128. The angle $d_1$ for this axis is equal to angle $b_2$, which is the refracted angle for the ray 130 having maximum output angle $a_2$. All rays from point 126 striking surface 122 between 120 and 124 will be at the maximum output angle. All rays from other points on the input will be at a lesser angle.

The procedure for the generation of parabolic surface 132 is identical but use is made of focal point 118. The length of the light conductor between opposite end surfaces 114 and 134 needed for the collimation is established by the intersection of ray 130 with the surface 122.

As was previously pointed out, there are certain forms of annularly shaped arc producing radiation devices which occasionally experience non-uniform distribution of its current in its conduction to the anode. This can result in one segment of the window becoming overheated, while another segment will be underheated which can result in deliterious effects on the window and surrounding environment, namely, either melting of the environment or deposition of anode material on the window as by condensation.

Figure 6:
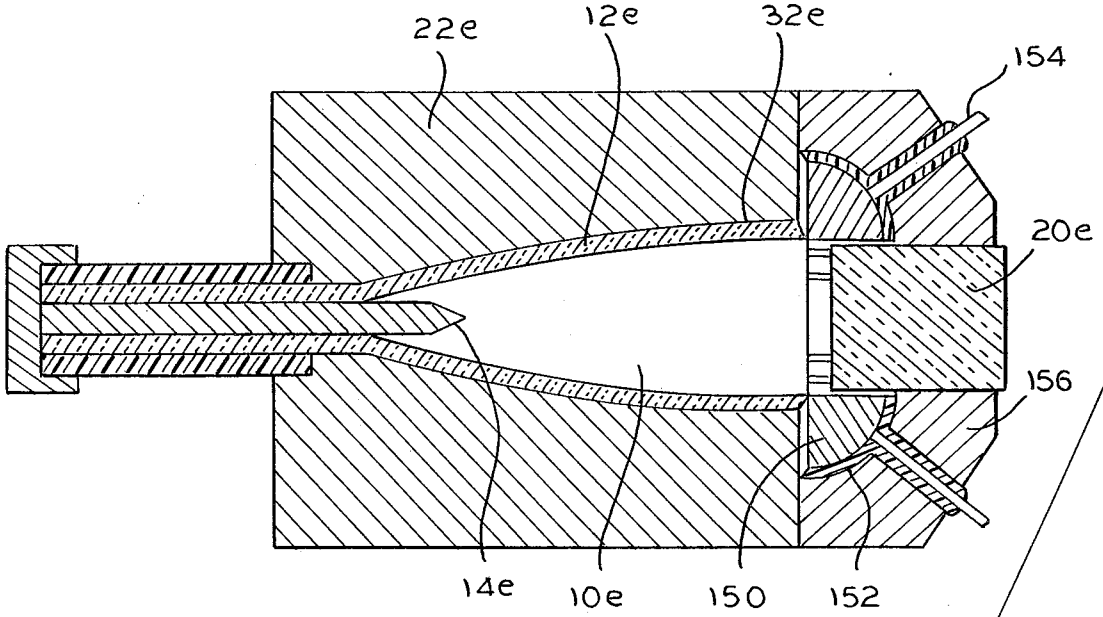
FIG. 6 is a side elevational view, in partial section, showing another embodiment of the present invention which utilizes a plurality of anodes annularly disposed about the window.

An object of the present invention is to provide a means whereby the distribution of the arc current adjacent the window can be made more uniform. A preferred embodiment for accomplishing this objective can be seen in FIGS. 6 and 7, wherein similar parts are designated by similar numerals with the addition of the suffix "e". This light source 8e includes an arc chamber 10e having an insulating chamber wall 12e and at one end thereof a cathode 14e. A co-axially disposed window 20e is disposed at the opposite end. Encircling the chamber wall 12e is an enclosing structure 22e that is rigid in nature and fabricated from material having the arithmetic product of its tensile strength and thermal conductivity substantially greater than the similar arithmetic product of the material from which said tube 12e is fabricated. The chamber 10e accepts a pressurized gas that increases in pressure, with the rise in the thermal gradients experienced within such an enclosure, and since the insulating material from which it is constructed cannot withstand such pressures or increased tensile forces created by the thermal gradients, it has been found necessary to surround the tube 12e to restrain the pressure and tensile forces generated in its operation. Not only is it necessary to physically restrain the tube 12e, but also it is necessary to provide suitable means for removal of the heat generated. Thus, it is desirable that a suitable material be chosen which will not only provide the physical strength but also to provide a proven thermal conductivity. Molybdenum is one such material, but others will be apparent to those skilled in the art. For the retention of a given pressure of said pressurized gas it is desirable for the thermal impedance between the inside wall of the tube 12e and a cooling medium which can be directed to the enclosing structure, i.e. ambient air or a water jacket. Thus, the reduced thermal impedance permits operation of said tube at a higher than normal power output (which produces the increased pressure an temperature) and results in higher than normal brightness.

To overcome the problem of non-uniform distribution of arc current, this embodiment utilizes a plurality of anodes 150 uniformly spaced circumferentially in an annular path about the window 20e. Each anode 150 is supported by insulating means 152 that includes means communicating with the exterior for supporting an anode lead wire 154. Positioned intermediate the anodes 150 are an equal number of passive anodes 160, these latter also being supported in and insulated by insulation 152. The active and passive anodes 150 and 160, respectively, can be positioned within a matrix of insulating material 164 for ease in assembly.

In this preferred embodiment the multiple anodes are distributed about the window in a uniform manner and are electrically isolated from one another. They are preferrably connected to separate sources 170 of current limited electrical power. The current to each anode thereby tends to be the substantially the same. If the current to one anode increases over that to the other anodes the current limiting element in its power source will reduce the voltage to that anode which serves to reduce its current and thereby limit the extent of the mismatch.

Figure 7:
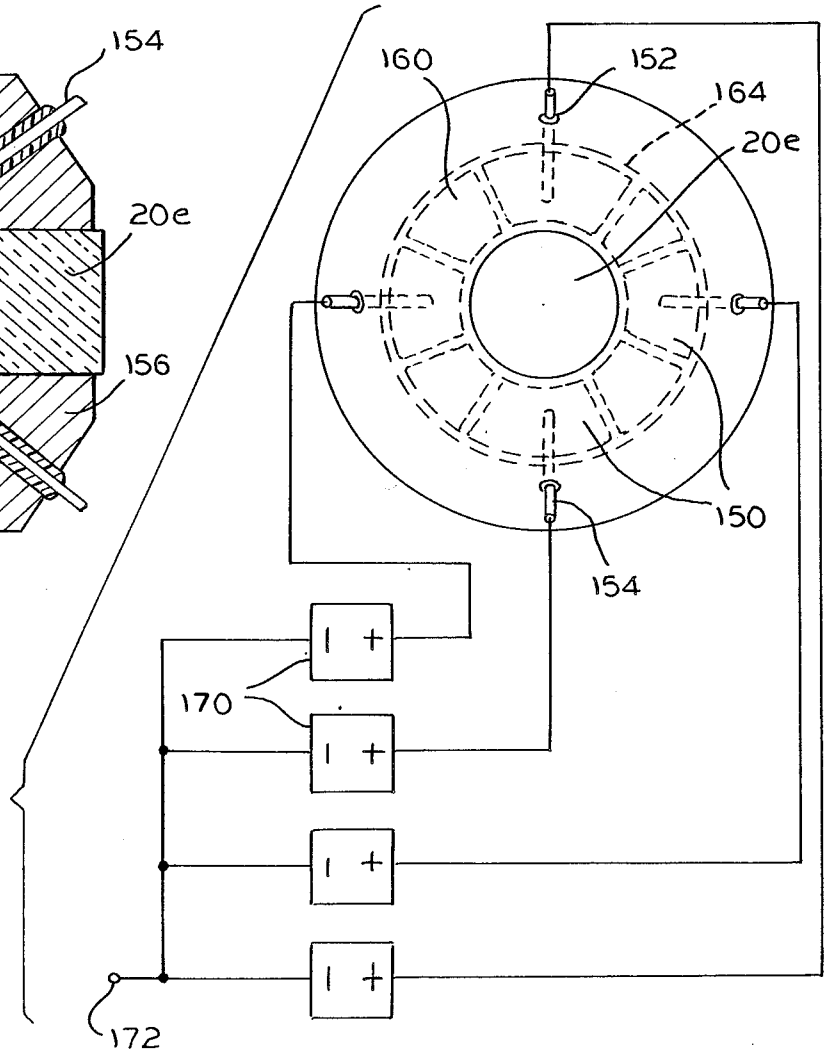
FIG. 7 is a schematic end view taken generally along line 7–7 in FIG. 6.

The passive anode sector elements 160, shown in FIG. 7, can be the same as the active anodes 150 except that they would not have power connections. Passive anodes 160 serve to provide uniform spacing between that active anodes 150 and help to maintain a good distribution of the arc current.

The end cap 156 is preferrably of the same material as the enclosing structure 22e to provide the same thermal conductivity and strength.

Figure 8:
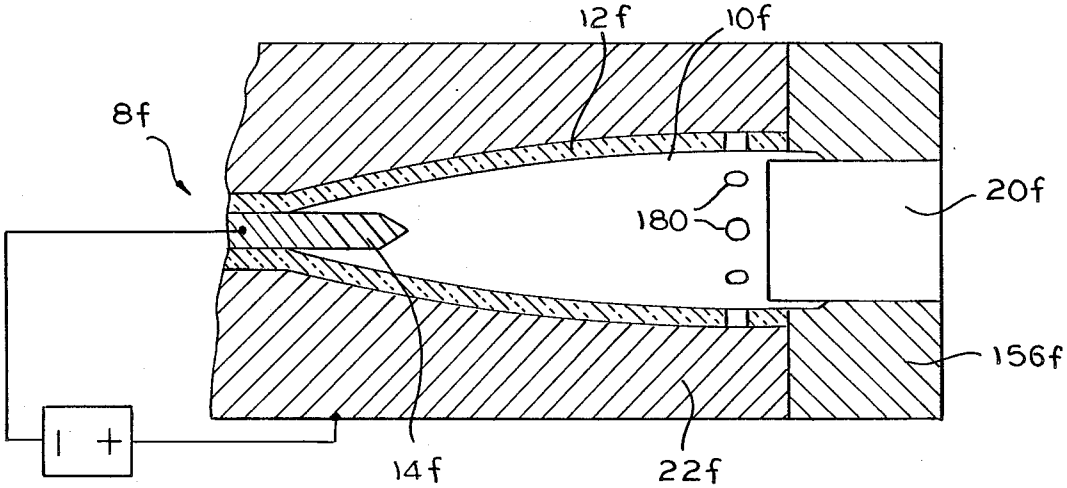
FIG. 8 is a partial side elevational view, in partial section, showing still another embodiment of the present invention but utilizing a plurality of ports or apertures in the insulating tube to provide a plurality of points at which an arc can be struck.

An alternate approach can be found in the embodiment shown in FIG. 8, wherein similar parts are shown by similar numerals with the addition of the suffix "f". In this embodiment the insulating tube 12f forming chamber 10f is restrained by the enclosing body 22b and end cap 156f, with a cathode 14f at one end and a window 20f at the opposite end. Adjacent the window 20f, the tube 12f is provided with a plurality of circumferentially spaced apertures 180 which communicate between the chamber 10f which will house the arc and the common anode formed by the surrounding body 22f.

Figure 9:
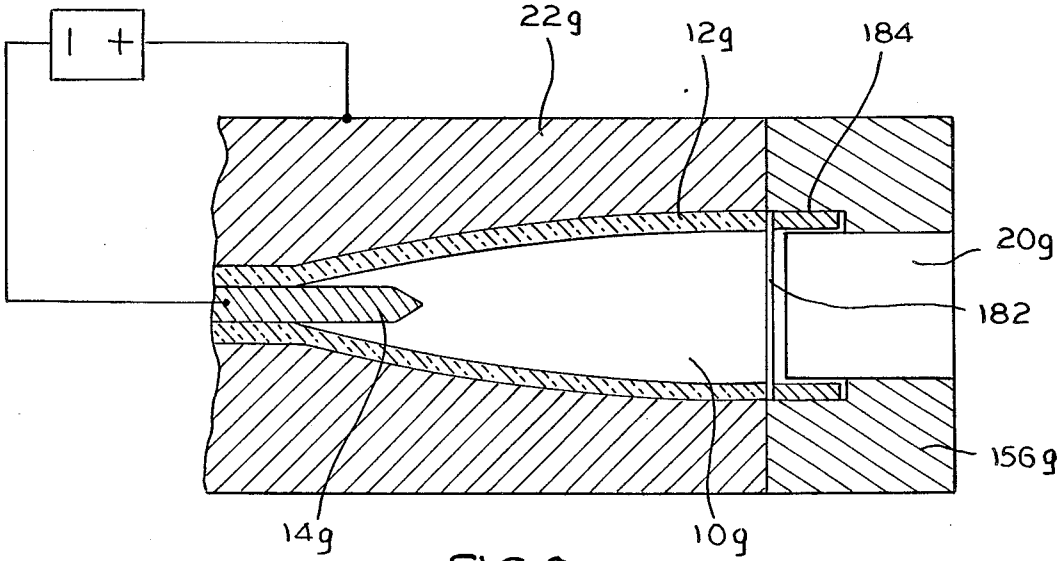
FIG. 9 is a further embodiment shown in a partial side elevational view, in partial section, wherein this embodiment utilizes an annular slit in the insulating tube to restrict the area of anode available for striking an arc and causing it to create a more uniform distribution.

Another embodiment is found in FIG. 9, wherein similar parts are designated by similar numerals with the addition of the suffix "f". This structure is related to that shown in FIG. 8 except that in this embodiment a slit 182 provides access to the common anode 22g, instead of the plurality of apertures shown in FIG. 8. In both of these last embodiments one provides a limited access to a common anode by the use of a number of small apertures or by the use of a slit. Because of the increased electrical impedence of these limited access regions there would be a tendency for the arc to reduce the overall impedence by distributing itself more uniformly.

Variations and equivalents will be apparent to those killed in the art and should only be limited to those defined in the attached claims.

I claim:

1. An optical radiation source including an electric arc discharge between electrodes in a pressurized gas, an elongated electrically insulating tabular element in which said arc is radially confined which radial confinement causes the arc to have a larger length to diameter ratio, thereby producing a higher electrical impedance in said arc and a higher brightness in an axial direction of said arc, a window co-axially positioned at one end of said tabular element which serves to transmit radiation from said arc that is emitted in said axial direction and a reflective surface that essentially conforms to a surface of said electrically insulating tubular element that redirects radiation incident to said reflective surface back to said arc and also to said window, an enclosing structure means having an interface with the outer surface of said insulating tube, said structure adapted to constrain the force of said internal gas pressure, and said enclosing structure means also adapted to conduct heat from said insulating tube, and external cooling means having access to said enclosing structure means.

2. An optical radiation source as claimed in claim 1 wherein said enclosing structure includes an intimate interface with the outer surface of said insulating tube.

3. An optical radiation source as claimed in claim 2 wherein said interface between said enclosing structure and said insulating tube is of significant thickness, a layer of thermally conductive material filling said interface, with said material being porous to said internal gas to facilitate balancing said gas pressure on opposite sides of said insulating tube and acceptance of the gas pressure by the enclosing structure.

4. An optical radiation source as claimed in claim 1 wherein said insulating tube is made of an opaque ceramic which serves to reflect radiation back to both said arc and said window by diffuse scattering.

5. An optical radiation source as claimed in claim 1 wherein said insulating tube is transparent and has a reflecting surface adjacent its outside surface.

6. An optical radiation source as claimed in claim 1 wherein said tubular element has a reflective surface said element and said reflective surface being concavely tapered to a larger open end diameter toward said window, whereby reflected radiation is preferentially reflected toward the window.

7. An optical radiation source as claimed in claim 2 wherein one of said electrodes is positioned adjacent said window said one electrode being disposed annularly and located about one circular edge of the window.

8. An optical radiation source as claimed in claim 7 wherein said one electrode by said window is the anode.

9. An optical radiation source as claimed in claim 7 wherein said window has limited thermal contact with cooling means so that its input surface is at an adequately high temperature to prevent the deposition of material from said annular electrode, and wherein the material of said annular electrode has an adequate vapor pressure at the temperature of said window to facilitate the prevention of such deposition.

10. An optical radiation source as claimed in claim 9 wherein said annularly disposed electrode is chosen from the class of materials consisting of silver, copper and cadmium.

11. An optical radiation source as claimed in claim 1 wherein said window is a light conduit with reflecting sidewalls.

12. An optical radiation source as claimed in claim 11 wherein said window is made from a material chosen from the class consisting of synthetic sapphire and fused silica.

13. An optical radiation source as claimed in claim 1 wherein a third electrode is positioned closer to one of said electrodes than the other electrode to facilitate striking the arc at a reduced voltage.

14. An optical radiation source as claimed in claim 1 wherein said insulating tube is made from a material chosen from the class consisting of synthetic sapphire and fused silica.

15. An optical radiation source as claimed in claim 12 wherein an external light conduit is closely coupled to receive radiation from an output surface of said window, said conduit being tapered to a larger diameter toward its opposite end and output face surface to cause increased collimation of the optical radiation, and in which said output face of the external light conduit is partially covered with reflective means to form a mask defining a predetermined shape exit aperture for permitting delivery of radiation having said predetermined shape and to reflectively return radiation to said arc that is outside the predetermined shape required.

16. An optical radiation source as claimed in claim 15 wherein said output face is provided with means to reflect radiation that is outside the spectral region required.

17. An optical radiation source including an electric and discharge between electrodes in a pressurized gas, an elongated electrically insulating tubular element in which said arc is established, a window co-axially positioned at one end of said tubular element which serves to transmit radiation from said arc that is emitted in an axial direction, a reflective surface that essentially Conforms to a surface of said electrically insulating tubular element that redirects radiation incident to said reflective surface back to said arc and also to said window and an enclosing structure means having an interface with the outer surface of said insulating tube, said structure adapted to constrain the force of said internal gas pressure, and said enclosing structure means also adapted to conduct heat from said insulating tube and external cooling means having access to said enclosing structure means to assist in the dissipation of heat therefrom.

18. An optical radiation source as claimed in claims 1 and 17 wherein said enclosing structure is adapted to apply a compressive force through its interface to said insulating tube to counteract tensile forces created in said insulating tube by internal gas pressure and thermal gradients.

19. An optical radiation source as claimed in claim 17 wherein said interface is of significant thickness, a layer of thermally conductive material filling said interface, said thermally conductive material being porous to said internal gal to facilitate balancing said gas pressure on opposite sides of said insulating tube and acceptance of said gas pressure by said enclosing structure.

20. An optical radiation source as claimed in claim 1 wherein said enclosing structure is fabricated from material having the arithmetic product of its tensile strength and thermal conductivity substantially greater than the similar arithmetic product of the material from which said tube is fabricated, whereby, for the retention of a predetermined pressure of said pressurized gas, the thermal impedance between the inside wall of said tube and the said cooling means is reduced, which reduced thermal impedance permits operation of said tube at a higher than normal power input and higher than normal brightness.

21. An optical radiation source as claimed in claim 17 wherein said enclosing structure is fabricated from material having the arithmetic product of its tensile strength and thermal conductivity substantially greater than the similar arithmetic product of the material from which said tube is fabricated, whereby, for the retention of a predetermined pressure of said pressurized gas, the thermal impedance between the inside wall of said tube and the said cooling means is reduced, which reduced thermal impedance permits operation of said tube at a higher then normal power input and higher than normal brightness.

22. An optical radiation source as claimed in claim 7 wherein said one electrode adjacent said window is the anode and is substantially annular in configuration.

23. An optical radiation source as claimed in claim 7 includes a plurality of active anodes disposed in circumferentially annularly arranged spaced relation about said window.

24. An optical radiation source as claimed in claim 23 wherein the plurality of active anodes are each connected to means for providing separate independent sources of current limited electrical power and said anodes are electrically isolated from each other.

25. An optical radiation source as claimed in claim 24 wherein said source includes a plurality of passive anodes which separate said plurality of active anodes, such separation providing uniform spacing between said active anodes, said passive anodes also contributing to the maintenance of good distribution of the arc current.

26. An optical radiation source as claimed in claim 23 wherein said source includes compartmentalized insulation means whereby said active anodes are electrically insulated from one another.

27. An optical radiation source as claimed in claim 26 wherein said insulation means includes means for accepting said passive anodes for disposition between said active anodes to assist in maintenance of the requisite spacing in said annular format.

28. An optical radiation source as claimed in claim 24 wherein said means for providing current limiting control are all connected in parallel with a common cathode.

29. An optical radiation source as claimed in claim 7 wherein said tube includes a plurality of relatively small apertures disposed circumferentially around said tube adjacent the open end aligned with said window, said apertures communicating between the chamber within said tube, which houses said cathode at the opposite end, and said enclosing structure means which serves as the common anode, said small apertures creating an increased electrical impedence which provides a tendency for said arc to reduce the overall impedence by distributing itself more uniformly.

30. An optical radiation source as claimed in claim 7 wherein said tube includes a relatively small annular slit disposed circumferentially around said tube adjacent the open end aligned with said window, said slit communicating between the chamber within said tube, which houses said cathode at the opposite end, and said enclosing structure means which serves as the common anode, said small slit creating an increased electrical impedence which provides a tendency for said arc to reduce the overall impedence by distributing itself more uniformly throughout said annular slit.

* * * * *